United States Patent [19]

Macleish

[11] 3,976,490

[45] Aug. 24, 1976

[54] REMOVABLE ANTIBLOCKING TOP COAT

[75] Inventor: William T. Macleish, North Andover, Mass.

[73] Assignee: Polaroid Corporation, Cambridge, Mass.

[22] Filed: Aug. 16, 1974

[21] Appl. No.: 498,060

[52] U.S. Cl. ..... 96/84 R; 96/76 R; 96/87 R

[51] Int. Cl.[2] ..... G03C 1/84; G03C 1/48; G03C 1/78; G03C 1/96

[58] Field of Search ..... 96/76 R, 76 C, 87 R, 96/84 R, 83

[56] References Cited

UNITED STATES PATENTS

| | | | |
|---|---|---|---|
| 3,240,604 | 3/1966 | Cook | 96/87 R |
| 3,295,979 | 1/1967 | Secrist et al. | 96/87 R |
| 3,316,198 | 4/1967 | Van Gorder et al. | 96/83 |
| 3,677,790 | 7/1972 | Bishop et al. | 96/84 R |

*Primary Examiner*—David Klein
*Assistant Examiner*—Richard L. Schilling
*Attorney, Agent, or Firm*—Philip G. Kiely

[57] ABSTRACT

The present invention is directed to diffusion transfer photographic products especially useful as film units in film packs or the like. Essentially the photographic products presented comprise a photosensitive element which after processing can provide a useable negative which is preferably produced concurrently with the formation of a positive image pattern.

10 Claims, 3 Drawing Figures

REMOVABLE ANTIBLOCKING TOP COAT

BACKGROUND OF THE INVENTION

1. Field of the Invention

This invention relates to diffusion transfer photography. More precisely, the invention disclosed herein relates to diffusion transfer photographic film units or products which can be developed outside of a camera after exposure and can provide a developed, useable negative concurrently with the formation of a positive transfer image pattern.

2. Description of the Prior Art

Copending application Ser. No. 403,037 filed Oct. 3, 1973 now U.S. Pat. No. 3,881,932, issued May 6, 1975, is directed to a photographic film unit suitable for use in photographic diffusion transfer processing wherein a developed, useable negative is formed concurrently with the formation of a positive image. More particularly, the aforementioned copending application is directed to a photosensitive element suitable for use in such a film unit which includes an opacifying system, e.g., a pigment or dye disposed in a polymeric matrix which can provide an effective adherent capability between a pellucid layer carrying a photosensitive layer and the opaque system until the photosensitive element is contacted with a fluid, which will cause swelling of the polymeric material in the matrix. In other words, the polymeric material provides a tight bond to the photosensitive sheet material only in the dry state. Upon swelling, the polymeric material no longer provides an adherent capability and the polymeric matrix separates or can be separated from the photosensitive element.

Copending application Ser. No. 408,374 filed Oct. 23, 1973 now U.S. Pat No. 3,900,323, issued Aug. 19, 1975 is directed to a backing layer particularly suitable for use as the opacifying system for a photosensitive element such as that set forth in the aforementioned application Ser. No. 403,037.

The above-mentioned applications Ser. Nos. 403,037 and 408,374 are herein incorporated by reference in their entirety.

Because of the hydrophilic nature of the polymeric matrix which would provide for its swelling and loss of adherent capability, conditions of high temperature and high humidity may cause blocking between the opaque backing layer and layers of adjacent film units. The present invention is directed to a novel film unit which is not susceptible to the deficiencies of the prior art.

SUMMARY OF THE INVENTION

The present invention is directed to photographic products comprising a photosensitive element which after processing, i.e., development and fixing, and, optionally, formation of a positive image, can provide a substantially transparent image-bearing member and which is distinctively adhered to an opaque plastomeric sheet material. Photosensitive elements of the type presented by the present invention are particularly useful for providing film units which can be developed outside a camera and the photosensitive elements are especially adaptable for use in film packs or magazines of the type described before. Essentially, the preferred products of the present invention employing the novel photosensitive elements comprise first and second sheet elements coupled together across their leading and sections. The first sheet element comprises a pellucid, e.g., substantially transparent or translucent, layer carrying on a first surface a photosensitive layer and, on a second surface, in order, an opaque plastomeric sheet material and an antiblocking top coat. The opaque plastomeric sheet material is distinctive in that it comprises an opacifying system, e.g., a pigment or dye, dispersed in a polymeric matrix which can provide an effective adherent capability between the pellucid layer and the plastomeric sheet material until the sheet material is contacted with a fluid, e.g., a liquid or gas, which can cause swelling of the polymeric material of the matrix. In other words, the polymeric material provides a tight bond to the photosensitive sheet material in the dry state only. Upon swelling, the polymeric material no longer provides an adherent capability and the plastomeric sheet material separates or can be separated from the photosensitive element. The opaque plastomeric sheet material has an optical density of at least about 6 and preferably at least about 9.

The top coat comprises a particulate material in a polymeric binder adhered to the opaque plastomeric sheet material. The size of the particles and the thickness of the binder are selected to provide for the protuberance of at least a portion of the particles to act as spacers and thus function as the primary antiblocking component. The polymeric binder material must function to hold the particulate material in place, provide some degree of antiblocking, but still permit the access of fluid to the opaque plastomeric material to permit removal. To achieve this result, the polymeric binder material comprises a combination of a hydrophilic and a hydrophobic polymer.

The second sheet member has an opaque support and can function merely as a spreader sheet. Preferably, however, the second sheet member carries on one surface thereof a diffusion transfer image-receiving element so arranged and positioned that the receiving element can receive a diffusion transfer image pattern from the photosensitive element when the first and second sheet members are placed in superposition and a fluid processing composition is distributed between the photosensitive and receiving elements.

The film units of the present invention further include a rupturable container containing a processing composition. In the preferred embodiment of the present invention the rupturable container is carried on the surface of the first sheet member between the leading edge thereof and the photosensitive element. In accordance with the manners well known to the art, the contents of the container are distributed between the photosensitive and image-receiving elements to thereby affect processing as the film unit is passed between pressure-applying members.

DESCRIPTION OF THE PREFERRED EMBODIMENT

The film units of the present invention are especially adaptable for use in a film pack or magazine comprising a plurality of individual film units. Each film unit includes a photosensitive element, a second element, preferably a print-receiving element which can be superposed with the exposed photosensitive sheet during processing, and a rupturable container of a processing fluid. Processing of the film unit is effected in the camera by a pair of pressure-applying members, preferably rolls, which engage the film unit as the latter is withdrawn from the camera and distribute a processing fluid from the container in a layer between the photosensitive and print-receiving elements. Each film unit includes a leader which serves as means, projecting from the camera, to be grasped for pulling the film unit from the camera between the pressure-applying members.

Figure 1:
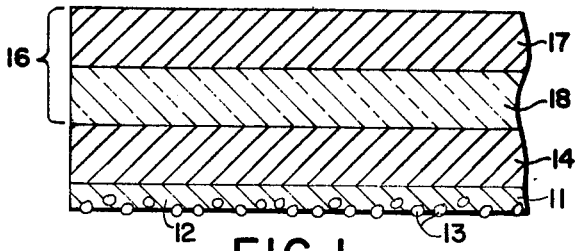
FIG. 1 is a fragmentary side view of a preferred arrangement of the essential elements of the essential members of the photosensitive elements of the present invention.

Reference is initially made to FIG. 1 where there is shown a fragmentary, cross-sectional view of the essential members of the photosensitive element of the present invention.

Photosensitive element 16 comprises photosensitive layer 17 carried on one surface of support 18. On the opposite surface of support 18 are opaque plastomeric sheet member 14 and top coat 11. The opaque plastomeric sheet member 14 provides partial protection for photosensitive element 16 after the unit has been removed from the camera until processing is complete.

Additional details relating to the opaque plastomeric sheet member 14 may be found in copending U.S. application Ser. No. 403,037 filed Oct. 3, 1973, which is incorporated by reference herein in its entirety.

Antiblocking top coat 11 is composed of particulate material 13 which acts as spacers and polymeric binder 12. Since it is necessary for fluid to contact sheet member 14 for removal from support 18, polymeric binder 12 must permit the passage of fluid at a relatively rapid rate. However, the use of a hydrophilic polymer as polymeric binder 12 would result in the take-up of moisture from the air thus, to some degree, negating the antiblocking properties of particles 13.

It has now been found that a combination of a hydrophilic and a hydrophobic polymer as polymeric binder 12 provides the necessary base for particles 13 and also provides a permeable matrix for the fluid to swell sheet member 14 without loss of anitblocking properties.

The terms "hydrophilic" and "hydrophobic" are used herein in the conventional manner. More particularly, a "hydrophilic" polymer is one which is swellable in the fluid to be employed in swelling and removing sheet member 14 and which is permeable and not a barrier to the fluid. A "hydrophobic" polymer is one which is substantially insoluble and will not swell in said fluid.

In a preferred embodiment, the ratio of hydrophilic polymer to hydrophobic polymer is 70:30 to 30:70 parts by weight. In a particularly preferred embodiment, the ratio is 50:50.

Any suitable particulate material may be employed in the top coat of the present invention. Both synthetic materials, such as polymeric beads, and natural materials, such as silica, may be employed. The particle size may range from about 2 to 30 $\mu$ in diameter, preferably 5 to 20 $\mu$ and more preferably 7 to 10 $\mu$. The preferred material is silica.

The specific top coat thickness will be determined at least in part to the speed with which the opaque is to be removed and the degree of antiblocking required. Generally, top coat thicknesses of about 100 to 600 mgs./ft.$^2$ are preferred.

The top coats of the present invention are applied from a solution or dispersion of the materials employing a liquid vehicle which is not a solvent for any of the underlying layers which may come into contact with the liquid to avoid dissolution of the underlying layers.

As examples of suitable hydrophobic polymers, mention may be made of the following:

cellulose acetate butyrate
polyvinyl acetate
styrene/acrylate copolymers
polyesters
cellulose acetate
ethyl cellulose As examples of suitable hydrophilic polymers, mention may be made of the following:

polyvinyl pyrrolidone
vinyl pyrrolidone/vinyl acetate copolymer
hydroxypropyl cellulose
ethylhydroxyethyl cellulose As examples of suitable particulate materials, mention may be made of the following:

polyvinyl chloride beads
polyethylene beads
silica
calcium carbonate

The following compositions are representative of top coats within the scope of the present invention:

| | Parts by weight | | |
|---|---|---|---|
| | Ex. 1 | Ex. 2 | Ex. 3 |
| Polyvinyl pyrrolidone | 30 | 60 | 70 |
| Cellulose acetate butyrate | 70 | 40 | 30 |
| Amorphous silica (avg. 7–10$\mu$) (Siloid 308 and Syloid 162, W. R. Grace & Company) | 25 | 25 | 25 |

The above compositions were coated with a 3 mil bar over opaque members described in copending application Ser. No. 403,307, dried for 3 minutes at 90° F. and then tested for blocking characteristics and speed of removal of the opaque member in clearing fluid. The samples were conditioned by subjecting them to 90° F. and 90% relative humidity for 24 hours and then applying 0.5 psi weight for 48 hours. Blocking was measured according to the following schedule:

0 = no blocking
2–3 = some sticking
5 = severe blocking, opaque layer removed

| | Removal in sodium sulfite solution (sec.) | | |
|---|---|---|---|
| Example | 12% | 18% | Blocking |
| 1 | 40 | 50 | 0 |
| 2 | 35 | 50 | 0 |
| 3 | 30 | 45 | 0 |
| Control (opaque layer with no top coat) | 30 | 50 | 2–3 |

The following compositions represent additional top coats within the scope of the present invention. The compositions were coated as described above. Removal was carried out in 12% sodium sulfite solution:

| | Ex. 4 | Ex. 5 | Ex. 6 |
|---|---|---|---|
| Ethyl cellulose | 30 | 50 | 70 |
| Vinyl pyrrolidone/vinyl acetate copolymer | 70 | 50 | 30 |
| Blocking | 0 | 0 | 0 |
| Removal time (sec.) | 50 | 75 | 150 |

| | Ex. 7 | Ex. 8 | Ex. 9 |
|---|---|---|---|
| Ethyl cellulose | 30 | 50 | 70 |
| Hydroxypropyl cellulose | 70 | 50 | 30 |
| Blocking | 0 | 0 | 0 |
| Removal time (sec.) | 75 | 120 | 165 |

Support or base member 18 is adhered to opaque back coat 14 and top coat 11 and after being separated therefrom provides a pellucid support for photosensitive layer 17. Accordingly, layer 18 can be fabricated of any material which can obtain the desired function. Especially preferred are those synthetic or naturally occurring polymeric materials which can provide substantially transparent, flexible support members. Accordingly, layer 18 may comprise any of the various types of transparent flexible supports, for example, polymeric films of both the synthetic type and those derived from naturally occurring products, etc. Especially suitable materials, however, comprise flexible transparent synthetic polymers such as polymethacrylic acid, methyl and ethyl esters; vinyl chloride polymers; polyvinyl acetals; polyamides such as nylon; polyesters such as the polymeric films derived from ethylene glycol terephthalic acid; polymeric cellulose derivatives such as cellulose acetate, triacetate, nitrate, propionate, butyrate, acetate-butyrate, or acetate propionate; polycarbonates; polystyrenes; and the like.

It should be understood that although transparent base member 18 is shown as one layer, more than one discrete layer of different polymeric materials can be employed to provide the assigned function of member 18.

The photosensitive layer 17 of element 16 can comprise one or more of the silver halides, such as photosensitive silver chloride, silver iodide, silver bromide, and preferably, mixed silver halides, such as silver chlorobromide, silver iodochloride, silver iodobromide or silver iodochlorobromide, of varying halide ratios and the silver concentrations dispersed in a processing composition permeable binder material such as gelatin and the like. Mixed silver halides comprising silver iodobromide and iodochlorobromide are especially preferred, particularly those comprising about 1 to 9% iodide by weight of silver.

Additional details regarding suitable photosensitive layers employed in the present invention may be found in copending application Ser. No. 403,037.

Figure 2:
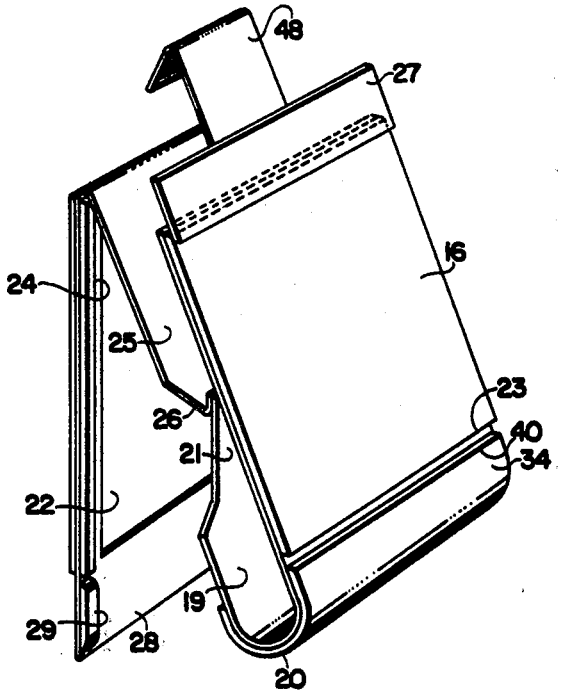
FIG. 2 is a fragmentary perspective view of a photographic film unit embodying the invention.
Figure 3:
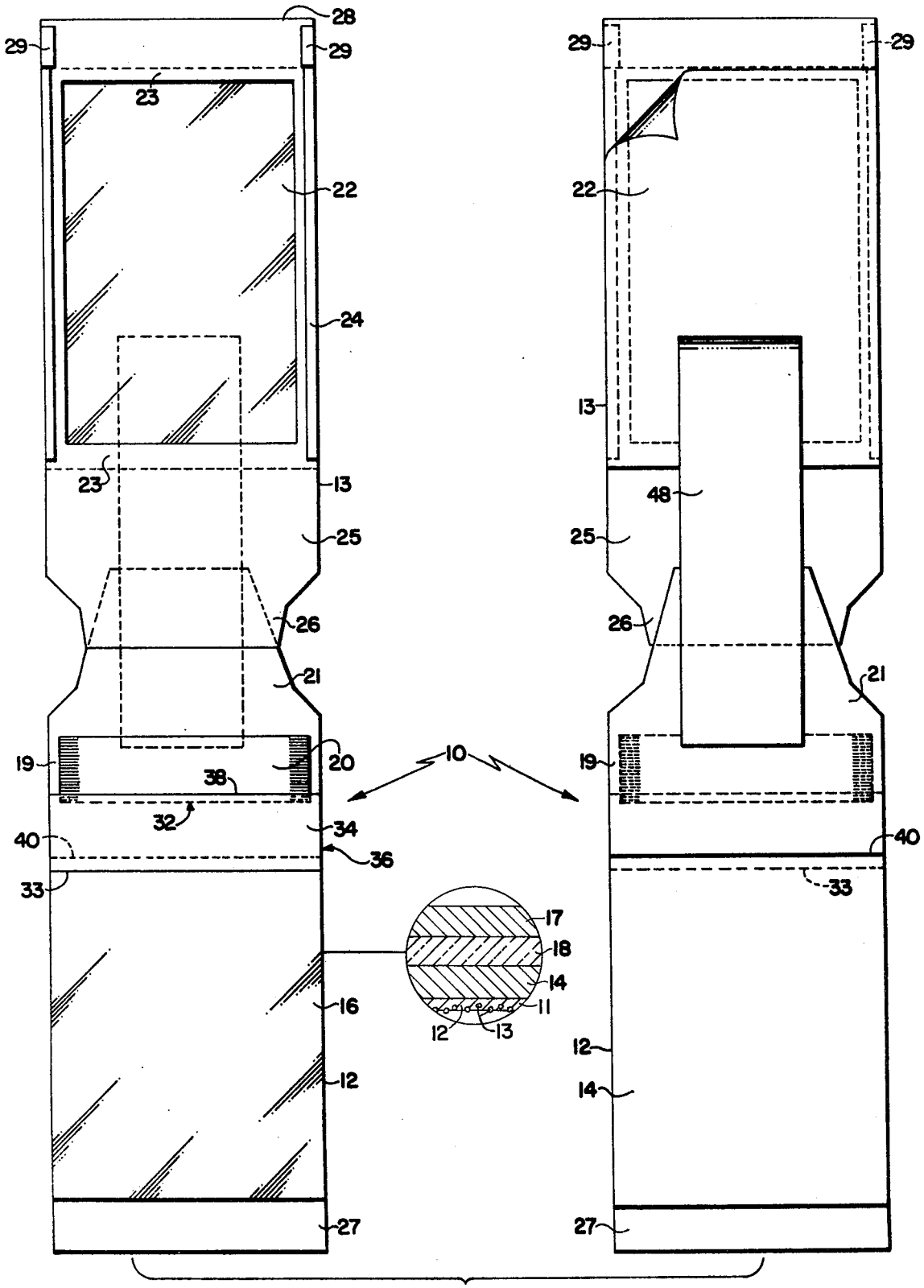
FIG. 3 is a front and rear plane view of the film unit of FIG. 2.

Reference is now made to FIGS. 1 through 3 of the drawings wherein there are illustrated film units of the present invention which can be employed in photographic products of U.S. Pat. No. 3,080,805. Each film unit designated 10 comprises a first sheet element 50 and a second sheet element 60. First sheet element 50 has as essential elements thereof photosensitive element 16 which comprises an opaque sheet material 14 and top coat 11 adhered to base layer 18 which, as mentioned, preferably provides an antilight piping capability for photosensitive system 17. Second sheet element 60 has a support which is opaque to activating radiation for photosensitive element 16 and can merely serve to aid in the distribution of a processing fluid in contact with layer 17 containing the photosensitive system. However, in the preferred film units, second sheet element 60 comprises a diffusion transfer image-receiving stratum arranged on element 60 so that said stratum can receive a diffusion transfer image pattern when elements 50 and 60 are in superposition.

First sheet element 50 has a leading end 19 which is approximately equal in width to photosensitive element 16 and provides means for mounting a rupturable container 20 containing processing fluid. Leading end section 19 is securely adhered to surface 17 of element 16 between trailing edge 33 of end section 19 and leading edge 62 of element 16 and sheet material 14 and also includes a tapered end section 21. First sheet element 50 further includes a trailing end section 27 preferably attached to the surface of photosensitive layer 17 of element 16 in the manner shown in detail in the front and rear views of FIG. 3.

Second sheet element 60 functions as a carrier sheet for image-receiving element 22 which is approximately equivalent in width to second sheet element 60. Element 60 further has a rectangular opening 23 which provides a border about image-receiving element 14 which border defines the area of receiving element 22 in which image formation can occur. Side guards 24 are secured to the side edges of second sheet element 60 providing the boundary about opening 23 to provide means to facilitate retention of the processing fluid between photosensitive element 16 and image-receiving element 22 when these elements are in superposition.

Second sheet element 60 also includes a leading edge portion 25 having a tapered end portion 26 similar to tapered end portion 21. The tapered end sections, e.g., 21 and 26, are secured together to define the leading end section of the film unit 10 to be advanced between pressure-applying members.

The length of sheet elements 50 and 60 is substantially equal and by virtue of this arrangement, the sheets are readily superposed in registered relation during the processing of the film unit. Trailing end section 27 of sheet element 50 extends beyond the trailing edge of photosensitive element 16 to coact with trailing end section 28 of sheet 60 to trap any excess processing fluid which may be carried beyond the trailing ends of the photosensitive element 16 during distribution of the processing fluid. Distribution of the processing fluid, as noted, is effected by advancing sheet elements 50 and 60 and container 20 of processing fluid, while elements 50 and 60 are in super-position between pressure-applying members. The pressure-applying members, e.g., opposed rolls, apply compressive pressure to the sheets progressively, beginning in the area of the container, to eject the fluid contents of the container between and in contact with the opposed surfaces of the photosensitive element 16 and receiving element 22. To aid in trapping of excess fluid, spacing members 29 may be provided on trailing end section 28 adjacent the margins thereof for spacing apart the pressure-applying members to provide a gap between trailing end section 27 and trailing end section 28 in which any excess processing fluid may be collected and retained.

Upon superpositioning of elements 16 and receiving element 22, the integrity of the so-formed laminate may be maintained during processing by mechanical means such as, for example, a plurality of polymeric hooks, e.g., nylon hooks, appropriately positioned on one contact surface and a plurality of filamentary loops on the second contact surface, such as the closure materials sold by Velcor Corporation, Manchester, New Hampshire. Also, a continuous or discontinuous adhesive layer or layers can be employed to form a seal between elements 16 and 22 to thereby facilitate processing external the camera in the presence of activating radiation. Such adhesive means may comprise a commercial pressure-sensitive adhesive such as that sold by the National Cash Register Company, Dayton, Ohio, under the trade designation PO1B-101 as a pressure activated capsular adhesive, and the like, so employed that the elements may be readily separated upon completion of processing by application of minimal force to the respective components.

The rupturable container can be of the type shown and described in U.S. Pat. Nos. 2,543,181; 2,634,886; 2,653,732; 2,674,532; 2,702,146; 2,723,051; 2,750,075; 3,056,491; and 3,056,492, and can comprise a rectangular blank of fluid- and air-impervious sheet material folded longitudinally upon itself to form two walls which are sealed to one another along the longitudinal and end margins to form a cavity in which the processing fluid is contained. Longitudinal marginal seal 32 is made weaker than the end seal so as to become unsealed in response to hydraulic pressure generated within the fluid contents of the container by the application of compressive pressure to the walls of the container. Container 20 is mounted on opaque sheet 50 with the longitudinal marginal seal directed toward the trailing edge 33 of end section 19. Bib sheet 34 is secured to opaque sheet 12 and at edge 38 on container 20, and facilitates restricted unidirectional flow of fluid contents of container 20 after rupture thereof. Edge 40 of bib sheet 34 terminates short of trailing edge 33 of end section 19 so that the flow of fluid contents from container 20 is directed to and distributed over layer 17 of element 16.

For details concerning the composition of the processing fluid, reference may be had to aforementioned U.S. Pat. Nos. 2,705,676 and 3,345,166.

As was mentioned, film units of the present invention are particularly useful as assemblage units of photographic film packs. The manners and methods for integrating the present film units in such film packs as well as the apparatus and structural elements involved are all set forth in the aforesaid U.S. Pat. No. 3,080,805 which is expressly incorporated herein by reference. Essentially a plurality of such film units are included in the pack which is designed to be accommodated within a camera so that the photosensitive surface 17 of first sheet member 50 of each film unit can be exposed to an image pattern of activating radiation. After exposure, the film unit is withdrawn from the exposure station and film pack in a fashion so that photosensitive layer 17 and image receiving layer 22 are in a superposed relationship and the processing composition of container 20 can be distributed between these layers. Tab 40 provides convenient means for withdrawing each unit from the pack.

After removal of the film unit from the camera and formation of a silver transfer image, a high quality usable negative is obtained by separating opaque sheet 14, top coat 11 and photosensitive element 16 from leading end section 19 of element 12 such as by tearing from end section 19. After separation from end section 19, sheet 14, top coat 11 and element 16 are contacted with a fluid which can cause the polymeric matrix of sheet 14 to swell so that sheet 14 and top coat 11 can be removed as from base member 18. In the preferred embodiment of the present invention, sheet 14 and top coat 11 are removed as a single piece and removal is complete within about a minute or less or the sheet 14 and top coat 11 may separate from each other. Since sheet 14 and top coat 11 are not soluble to any appreciable extent in the removal fluid employed, the sheet can be removed from the fluid without contamination of the fluid by the matrix material of sheet 14 or top coat 11. This feature is important when the removal fluid also contains other ingredients which can fix or harden or otherwise treat the emulsion surface of member 16.

A positive diffusion transfer image pattern containing element can be obtained by separating receiving element 22 from second sheet member 60 in the manner shown in the rear view of FIG. 3.

Film packs were assembled embodying the anti-blocking top coat of the present invention and stored at 90° F. and 90% relative humidity for 5 days. At the end of the time, no functional failures due to blocking were observed.

As can be appreciated from the foregoing detailed description, the essence of the invention resides in the novel photosensitive elements presented which comprise an opaque plastomeric sheet material and anti-blocking top coat releasably adhered to a photosensitive system which can provide — after processing and removal from the opaque plastomeric sheet material and top coat — a substantially transparent image-bearing member useful in providing high quality reproductions. Accordingly, the novel photosensitive elements are especially useful in diffusion transfer photographic products particularly those described in the above detailed description of the preferred embodiment. However, since certain changes can be made in the above disclosed products without departing from the spirit and scope of the essence of the invention, it is intended that all matter contained in the above description or shown in the accompanying drawings shall be interpreted as illustrative and not in a limiting sense.

What is claimed is:

1. A photosensitive element which comprises a photosensitive silver halide layer coated on a first surface of a pellucid plastomeric layer and, coated on a second surface of said plastomeric layer, an opaque plastomeric sheet material; said sheet material comprising a substantially water-insoluble, fluid swellable polymeric material adapted to lose adhesive capability upon swelling, thereby separating from said pellucid layer and a top coat comprising particulate material in a binder material, said binder material comprising a hydrophilic polymer and a hydrophobic polymer.

2. A photosensitive element of claim 1 wherein said opaque plastomeric sheet material has an optical density of at least about 6.0.

3. The photosensitive element of claim 1 wherein the ratio of said hydrophilic polymer to said hydrophobic polymer is from 70:30 to 30:70 parts by weight.

4. The photosensitive element of claim 3 wherein said ratio is 1:1.

5. The photosensitive element of claim 1 wherein said particulate material is selected from the group consisting of synthetic and natural materials.

6. The photosensitive element of claim 5 wherein said particulate material has a particle size of 5–20 microns.

7. The photosensitive element of claim 6 wherein said particulate material has a particle size of 7–10 microns.

8. The photosensitive element of claim 5 wherein said particulate material is silica.

9. The photosensitive element of claim 1 wherein said hydrophilic polymer is polyvinyl pyrrolidone and said hydrophobic polymer is cellulose acetate butyrate.

10. The photosensitive element of claim 1 wherein said opaque plastomeric sheet material comprises a polymeric material chosen from the group consisting of polyvinyl alcohol, polyacrylamides, carboxyalkycelluloses and mixtures thereof and carbon black as the opacifying material.

* * * * *